US008950320B2

(12) United States Patent
Nabity et al.

(10) Patent No.: US 8,950,320 B2
(45) Date of Patent: Feb. 10, 2015

(54) PORTABLE ROLLER PRESS

(75) Inventors: Stephen Nabity, Elkhorn, NE (US); Bryan Hunter, Round Rock, TX (US); Peter Kaltenbach, Austin, TX (US); Henric Jentz, Austin, TX (US)

(73) Assignee: Tek Industries, Inc., Fremont, NE (US)

( * ) Notice: Subject to any disclaimer, the term of this patent is extended or adjusted under 35 U.S.C. 154(b) by 637 days.

(21) Appl. No.: 13/124,187

(22) PCT Filed: Oct. 14, 2009

(86) PCT No.: PCT/US2009/060623

§ 371 (c)(1), (2), (4) Date: Jul. 7, 2011

(87) PCT Pub. No.: WO2010/045312

PCT Pub. Date: Apr. 22, 2010

(65) Prior Publication Data

US 2011/0252939 A1 Oct. 20, 2011

Related U.S. Application Data

(60) Provisional application No. 61/105,268, filed on Oct. 14, 2008.

(51) Int. Cl.

| | |
|---|---|
| ***B30B 3/04*** | (2006.01) |
| ***B26F 1/42*** | (2006.01) |
| ***B26F 1/44*** | (2006.01) |
| ***B26F 1/38*** | (2006.01) |
| *B26D 5/10* | (2006.01) |
| *B26D 7/00* | (2006.01) |

(52) U.S. Cl.

CPC . *B26F 1/42* (2013.01); *B26F 1/384* (2013.01); *B26D 5/10* (2013.01); *B26D 2007/0087* (2013.01)

USPC ..... 100/176; 100/173; 100/282

(58) Field of Classification Search

USPC ..... 100/76, 121, 155 R, 172, 173, 176, 280, 100/282, 288, 292; 72/211, 449; 425/363, 425/298, 411; 83/284, 491, 859

See application file for complete search history.

(56) References Cited

U.S. PATENT DOCUMENTS

| | | | | |
|---|---|---|---|---|
| 3,264,978 | A * | 8/1966 | Staley | 101/23 |
| 3,498,215 | A * | 3/1970 | Brinkman | 100/155 R |
| 5,647,260 | A * | 7/1997 | Nabity | 83/522.12 |
| 5,778,748 | A * | 7/1998 | Beijen | 83/529 |
| 7,335,009 | B2 * | 2/2008 | Lee | 425/298 |
| 7,360,482 | B2 * | 4/2008 | Deng | 100/176 |
| 7,464,631 | B2 * | 12/2008 | Nottingham et al. | 83/522.12 |
| 7,743,700 | B2 * | 6/2010 | Ayala et al. | 100/176 |

(Continued)

*Primary Examiner* — Jimmy T Nguyen

(74) *Attorney, Agent, or Firm* — Tek Industries, Inc.; David H. Milligan, PC

(57) ABSTRACT

A portable roller press that includes a base frame having a pair of opposing stanchions, a drive roller assembly having upper and lower rollers extending between and rotatably mounted to the stanchions, a pair of opposing wings that are hingedly coupled to the base frame and selectively movable between open and closed positions, and an idler roller rotatably mounted to each of the wings. The wings have recessed portions that together substantially enclose the drive roller assembly when the wings are in closed positions. Additionally, when the wings are in their closed positions, the idler rollers are contained in a void space between the upper and lower rollers. The wings can be substantially hollow and arc configured for holding and transporting items therein.

14 Claims, 5 Drawing Sheets

(56) References Cited

U.S. PATENT DOCUMENTS

2005/0034785 A1* 2/2005 Lovchik et al. ..... 144/356
2005/0061168 A1* 3/2005 Corcoran et al. ..... 100/219
2005/0268761 A1* 12/2005 Corcoran et al. ..... 83/13
2007/0163453 A1* 7/2007 Lee ..... 100/176
2007/0214972 A1* 9/2007 Ayala et al. ..... 100/176

* cited by examiner

PORTABLE ROLLER PRESS

CROSS-REFERENCE TO RELATED APPLICATIONS

This application is a continuation of and claims the benefit of and priority to U.S. Provisional Patent Application No. 61/105,268, filed Oct. 14, 2008, entitled PORTABLE ROLLER PRESS, which document is hereby incorporated by reference to the extent permitted by law.

BACKGROUND OF THE INVENTION

Die cutting machines have been used for many years for cutting shapes and patterns from paper and other stock material used, for example, in scrapbooking and creating bulletin board displays. More recently, die cutting machines have been used for cutting shapes and patterns from fabric, cloth and other textiles used, for example, in quilt making.

Die cutting machines permit a material to be cut into a shape or pattern more quickly and with more precision than is possible with other means of cutting, such as with a scissors. One type of die cutting machine or roller press is configured to pass a die assembly between a pair of compression rollers which compress the die assembly to cut the material. The conventional die assembly includes a base plate, a steel cutting die protruding from the base plate, a neoprene-like material surrounding the steel cutting die, and frequently a cover plate. The cutting die is normally steel blade with a sharpened edge that traces the perimeter of a desired shape, such as a letter or design.

A piece of material is typically placed between the cutting die and the cover plate. As the die assembly passes between the compression rollers, it is compressed such that the sharpened edge cuts through the material to produce the desired shape.

Die cutting machines and roller presses are well known in the art. However, because it has become desirable to use die cutting machines during scrapbooking parties, quilting club meetings and the like, a need exists for a portable die cutting machine. While attempts have been made to create a portable die cutting machine, as illustrated in U.S. Patent Publication Nos. US 2005/0268761 to Corcoran et al. and US 2007/0214372 to Ayala et al., these attempts have had downfalls. For example, in an effort to reduce their size, the machines have been designed to have a smaller footprint, thereby leading the machines to have stability problems when they are supporting die assemblies or when their crank handles are being rotated by an operator. Mechanisms, such as suction cups, have been added to the bottom of the machines in an attempt to help stabilized them. Another downfall to these machines is that, due to their stability problems, the size of the surface on which the die assembly rests has been reduced, thereby leading to stability issues with the die assembly and reducing the size of die assembly that can be placed through the machine.

Accordingly, a need exists for a portable die cutting machine that is lightweight, yet stable in use. A need also exists for a portable die cutting machine that includes surfaces of increased size on which a die assembly can rest, while having a reduced profile for transport and storage. A further need exists for a portable die cutting machine that can enclose on itself, so as to become of a smaller size during transport and storage.

SUMMARY OF THE INVENTION

One embodiment of the present invention is directed to a portable roller press that includes a base frame having a pair of opposing stanchions, a drive roller assembly having upper and lower rollers extending between and rotatably mounted to the stanchions, and at least one wing that is selectively movable between open and closed positions. The wing has a surface for supporting a die assembly and a recessed portion that at least partially encloses the drive roller assembly when the wing is in a closed position.

Another embodiment of the present invention is directed to a portable roller press that includes a base frame having a pair of opposing stanchions, a drive roller assembly having upper and lower rollers extending between and rotatably mounted to the stanchions, a pair of opposing wings that are hingedly coupled to the base frame and selectively movable between open and closed positions, and an idler roller rotatably mounted to each of the wings. The wings have recessed portions that together substantially enclose the drive roller assembly when the wings are in closed positions. Additionally, when the wings are in their closed positions, the idler rollers are contained in a void space between the upper and lower rollers.

Other and further objects of the invention, together with the features of novelty appurtenant thereto, will appear in the course of the following description.

DESCRIPTION OF THE SEVERAL VIEWS OF THE DRAWING

In the accompanying drawing, which form a part of the specification and are to be read in conjunction therewith in which like reference numerals are used to indicate like or similar parts in the various views.

DETAILED DESCRIPTION OF THE PREFERRED EMBODIMENTS

Figure 1:
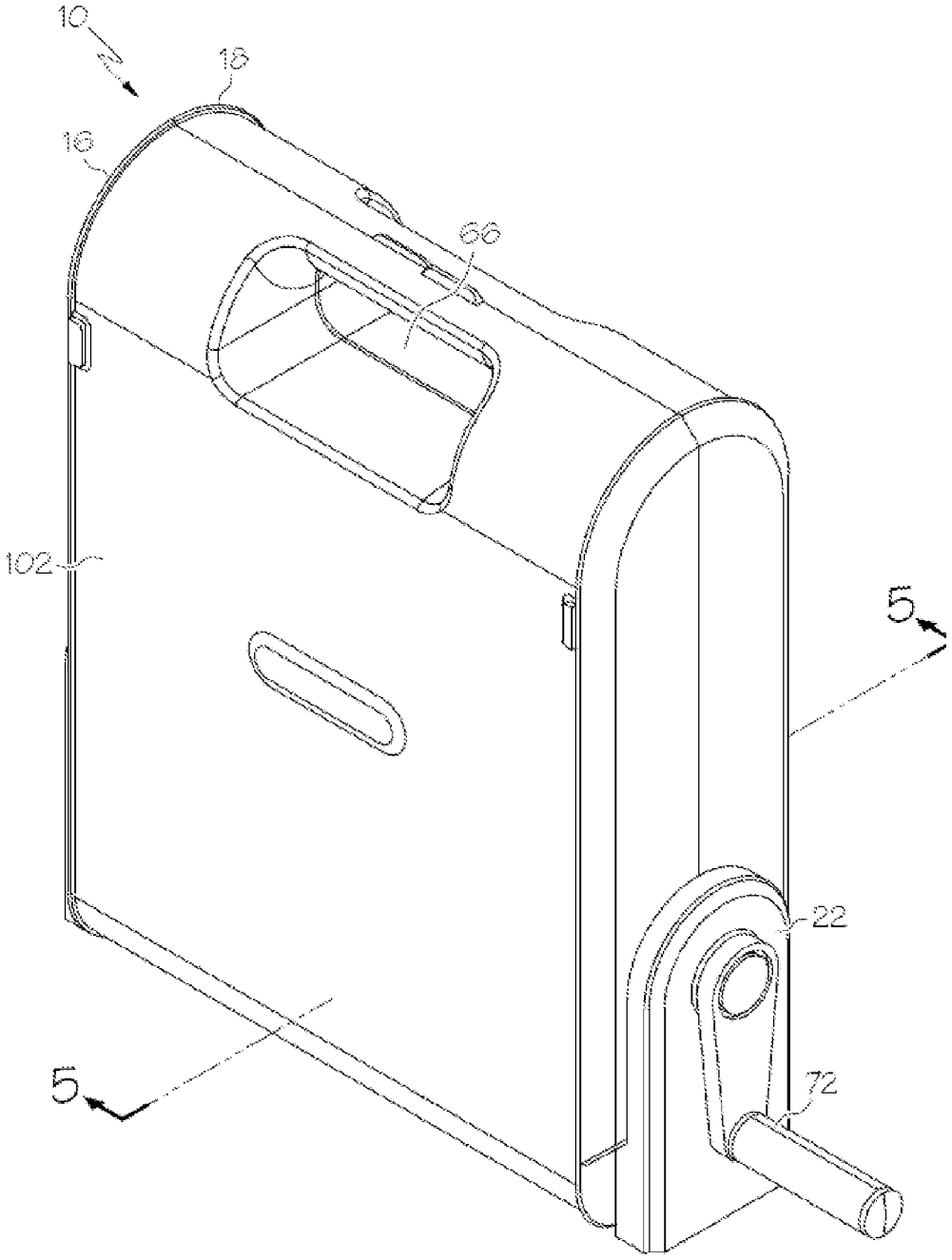
FIG. 1 is a left perspective view of a portable roller press having its wings in closed positions in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Figure 2:
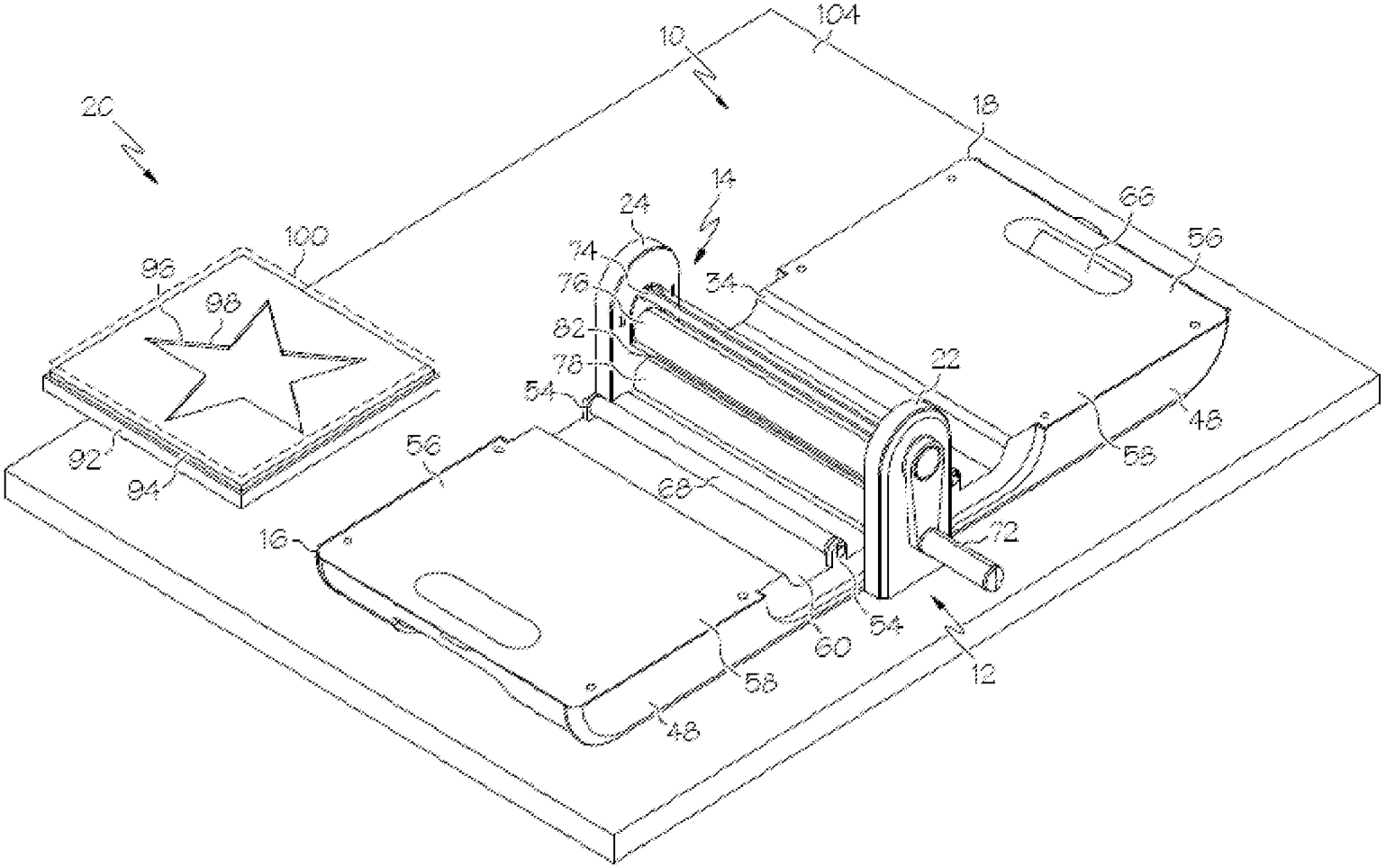
FIG. 2 is a top perspective view of a portable roller press having its wings in open positions and a die assembly in accordance with one embodiment of the present invention.

One embodiment of the present invention is directed to a roller press or die cutting machine 10 that can be used in connection with a conventional die assembly 20 for cutting shapes, patterns, and other designs from pieces of material 100 (shown in hidden lines). As shown in FIG. 2, the roller press 10, which is designed to be portable, includes a base frame 12, a drive roller assembly 14, and two opposing wings 16 and 18 that are hingedly coupled to the base frame 12. The wings 16 and 18 can be folded into a closed position and are configured for enclosing the drive roller assembly 14 during transport and storage.

Figure 3:
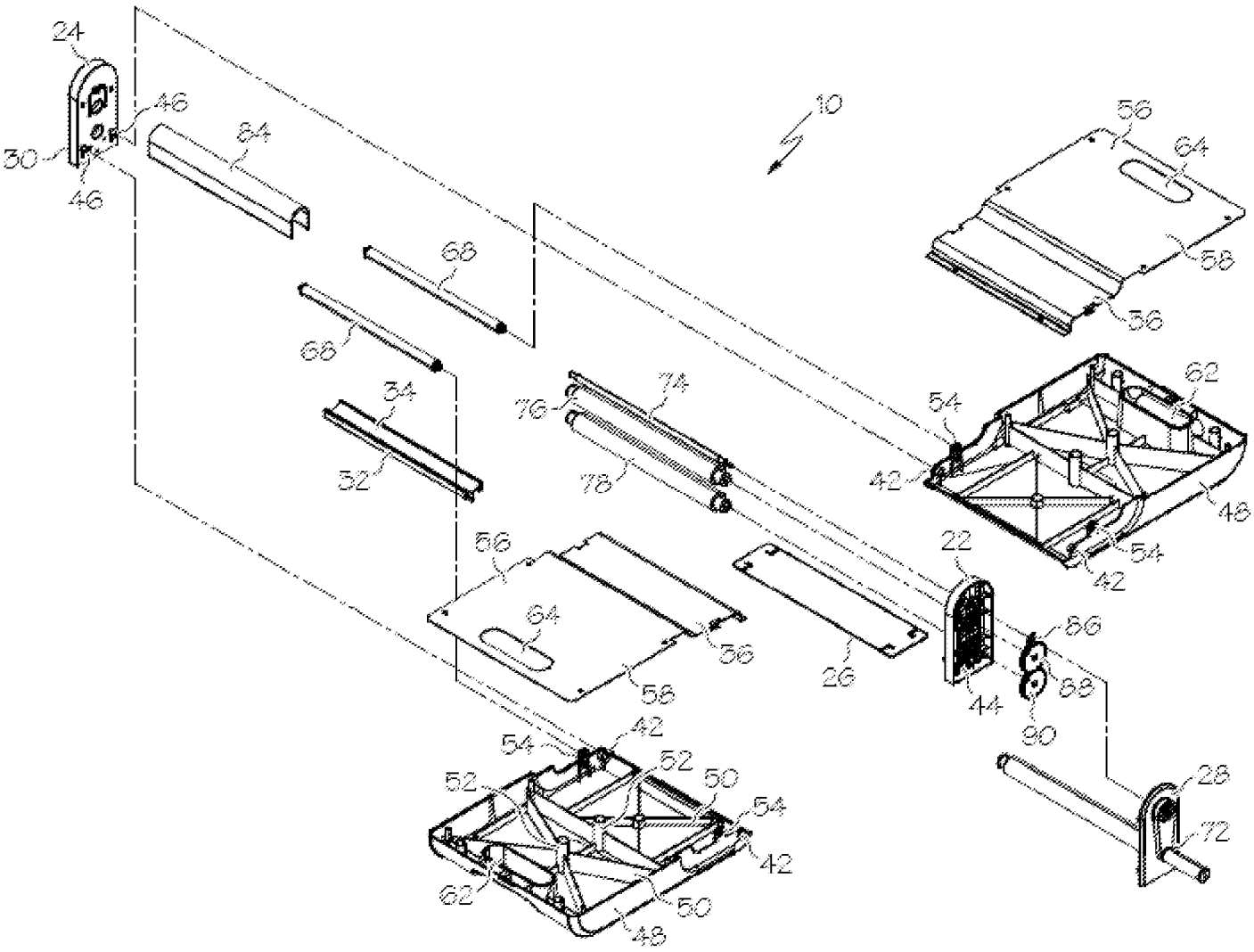
FIG. 3 is an exploded view of a portable roller in accordance with one embodiment of the present invention.

Referring to FIG. 3, it is shown that the base frame 12 of the roller press 10 includes a base plate 26, a lateral support member 32 and two upwardly extending stanchions 22 and 24. Though not shown in the figures, the opposing stanchions 22 and 24 can be secured to the base plate 26 with screws or other similar fasteners. Likewise, the lateral support member 32 can be secured to the stanchions 22 and 24 with screws or other similar fasteners. The base frame 12 can also include cover plates 28 and 30 that are removably attached to the stanchions 22 and 24 in order to enclose the innerworking mechanisms therein.

As illustrated in FIG. 2, the drive roller assembly 14 includes elongated upper and lower rollers 76 and 78 that extend between and are rotatably mounted to the stanchions 22 and 24. The upper and lower rollers 76 and 78 define a feed space 82 therebetween. In use, the die assembly 20 is drawn through the feed space 82 between the upper and lower rollers 76 and 78, as described in further detail below. The feed space 82 is sized to accommodate a die assembly 20 of a particular thickness.

The upper and lower rollers 76 and 78 are operably engaged with and can be driven by a crank handle 72 or, in the alternative, by an electric motor (not shown). The crank handle 72 can be removable from the roller press 10 to further facilitate transportation and storage. As shown, the crank handle 72 is coupled with a drive gear 86. The drive gear 86 acts as the initial transmission gear. As illustrated in FIG. 3, the drive gear 86 is engaged with an upper roller gear 88, which is coupled to the upper roller 76. The upper roller gear 88 in turn is engaged with the lower roller gear 90, which is coupled to the lower roller 78. Thus, when the handle 72 is rotated in a clockwise direction, the upper roller 76 will be driven in a counter-clockwise direction and the lower roller 78 will be driven in a clockwise direction. This opposing rotation action of the upper and lower rollers 76 and 78 pulls the die assembly through the rollers 76 and 78.

The drive roller assembly 14 also includes a shaft 74 that extends between and is rotatably mounted to the stanchions 22 and 24. The shaft 74 is coupled to the crank handle 72 and acts to stabilize the axis of the drive gear 86 as well as the upper portions of the stanchions 22 and 24. A protective cover or shield 84 is also provided with the drive roller assembly 14 to prevent a user from catching his or her fingers in the drive roller assembly 14.

Figure 5:
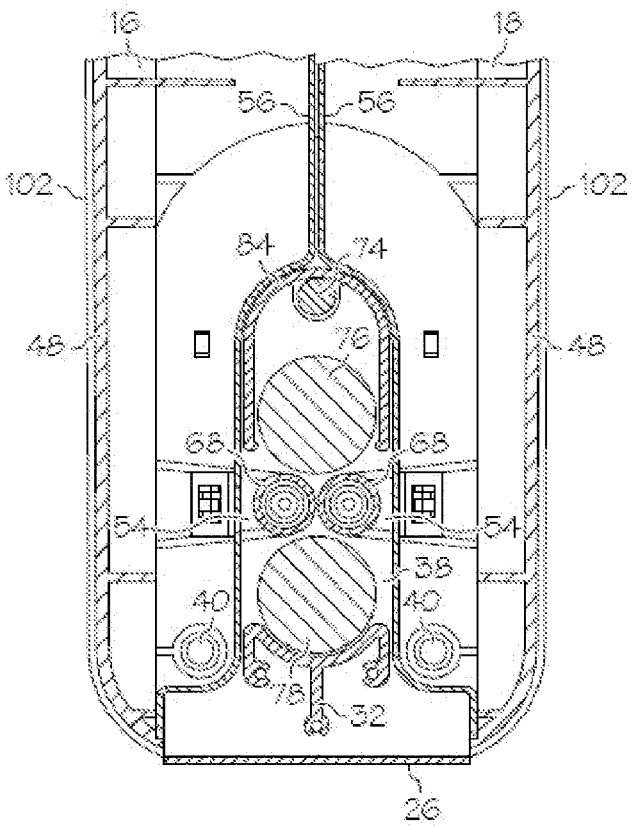
FIG. 5 is a cross-sectional view of the portable roller press of FIG. 1 taken generally along line 5-5, in the direction of the arrows.

As mentioned above, the roller press 10 has wings 16 and 18 that are hingedly attached to the stanchions 22 and 24. The wings 16 and 18 are selectively movable between open and closed positions. As illustrated in FIG. 2, when the wings 16 and 18 are in open positions, they serve as a means for supporting the die assembly 20 before, while, and after the die assembly 20 it passes through drive roller assembly 14. As illustrated in FIGS. 1 and 5, when the wings 16 and 18 are in closed positions, they serve as a means for enclosing and protecting the drive roller assembly 14. In one embodiment, the roller press 10 only includes one wing 16.

Referring once again to FIG. 3, each wing 16 and 18 is comprised of a housing portion 48 and a plate portion 56. The housing portion 48 can be a shell-like member having an internal structural framework or webbing 50. This substantially hollow, shell-like configuration reduces the overall weight of the roller press 10, which is advantageous to its portability. In one embodiment, the housing portion 56 is configured for holding and storing items such as the handle 72, scrapbooking supplies, quilting supplies, and the like during transportation and storage of the roller press 10.

The plate portion 56 includes a die support surface 58 and an enclosure surface 36. When the plate portion 56 is assembled with the housing portion 48, the plate portion 56 can be further supported by the webbing 50 and pedestals 52 extending from the webbing 50. Additionally, the housing portion 48 and the plate portion 56 can each have apertures 62 and 64 respectively therethrough that define a handle 66 when the housing portion 48 and plate portion 56 are assembled.

Figure 4:
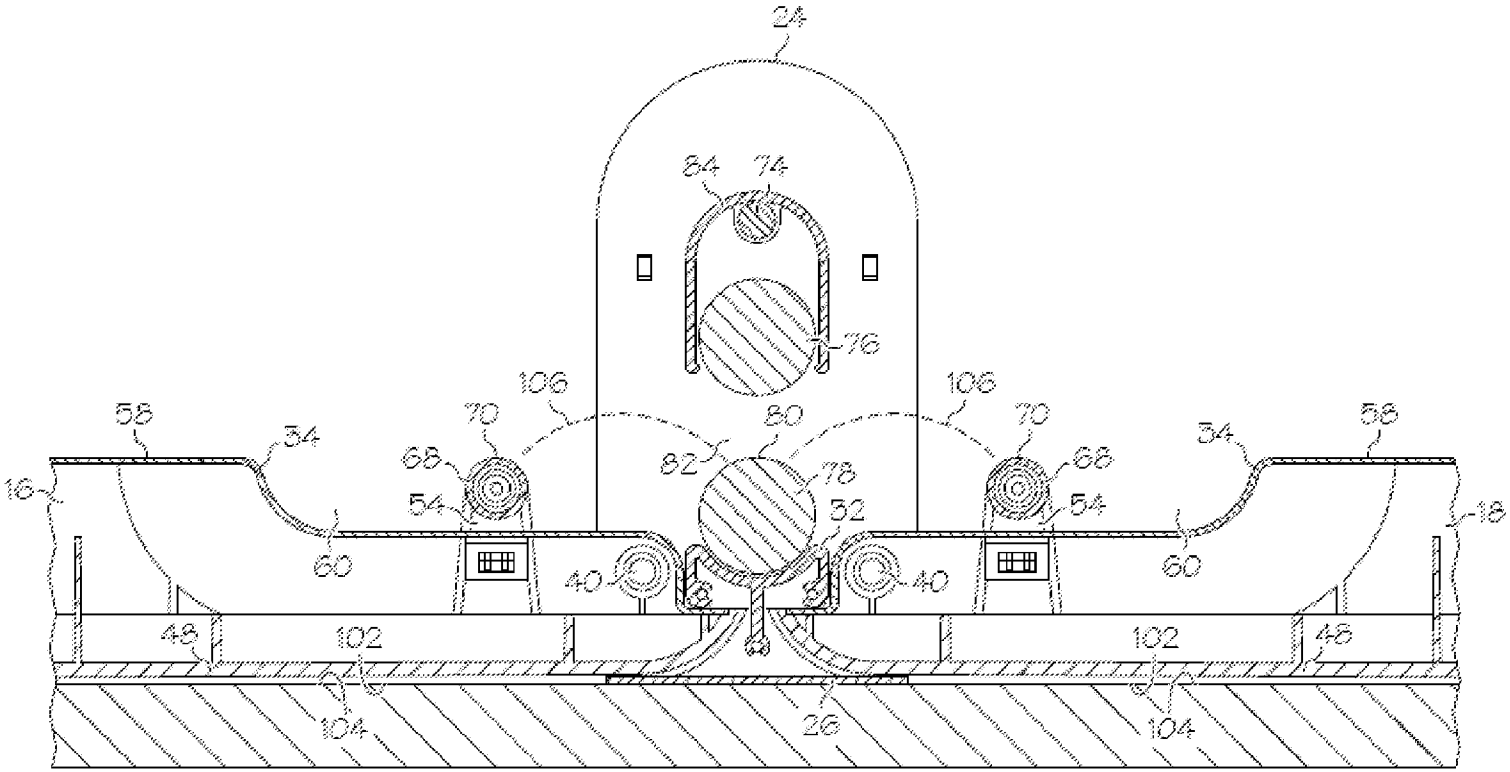
FIG. 4 is a partial cross-sectional view of the portable roller press of FIG. 2 taken generally along line 4-4, in the direction of the arrows.

The wings 16 and 18 can be hingedly attached to the base frame 12 in any of a number of ways. As shown in FIGS. 4 and 5, the wings 16 and 18 are connected to the stanchions 22 and 24 of the base frame 12 by hinges 40. As illustrated in FIG. 3, the wings 16 and 18 can have apertures 42 therethrough that define a hinge point. Likewise, the stanchions can have apertures 44 therethrough and the wings 16 and 18 can be hingedly coupled to the stanchions 22 and 24 by way of pins 46, rods, bolts, or the like. In another embodiment, either the wings 16 and 18 or the stanchions 22 and 24 have circular bosses (not shown) protruding therefrom that are rotatably inserted into the respective apertures 42 and 44 of the other.

As mentioned above, in use, the die assembly 20 is fed through the drive roller assembly 14 between the upper and lower rollers 76 and 78. As shown in FIG. 2, the die assembly 20 can include a wooden or plastic base plate 92, a steel cutting rule 96 protruding from the base plate 92, a layer of compressible or pliant material 94, such as rubber, foam, neoprene, or the like surrounding the cutting rule 96, and frequently a cover plate (not shown). A piece or pieces of material 100 are typically placed on top of the cutting rule 96. As shown in FIG. 2, the steel cutting rule 96 is formed in the shape of a star and includes an upper sharpened edge 98. The roller press 10 and die assembly 20 can be adapted for cutting materials 100 that include, by way of example, paper, card stock, fabric, cloth, textiles, leather, aluminum foil, vinyl, and plastic sheets.

Once the material 100 is placed on top of the cutting rule 96, the die assembly 20 and material 100 are drawn through the upper and lower rollers 76 and 78 by way of the user cranking the handle 72. The upper roller 76 preferably has a resilient compressible surface so as to engage the cutting edge 98 of the rule 96 as the die assembly 20 is drawn through the roller assembly 14. As the die assembly 20 is drawn through the roller assembly 14, the cutting edge 98 cuts through the material 100 and presses into the surface of the upper roller 76, thereby cutting a shape or shapes from the material 100.

As demonstrated in FIGS. 1 and 5, the wings 16 and 18 can be folded into closed positions to create a compact configuration for transport and storage. When the wings 16 and 18 are in closed positions, they encase the drive roller assembly 14. In that regard, each of the wings 16 and 18 has a recessed portion 60. When the wings are in closed positions, their recessed portions 60 come together to form a cavity 38 that encloses the roller assembly 14. In addition to creating a compact configuration, this protects the roller assembly 14 and its components from incidental damage and the elements during transport and storage.

Due to the recessed portions 60 that enclose the roller assembly 14, there is a significant distance between an inner edge 34 of the die support surface 58 and the lower roller 78 in which the die assembly would be unsupported when being fed through the roller assembly 14, as best seen in FIGS. 2 and 4. However, the wings 16 and 18 can each include an idler roller 68 located proximate the recessed portions 60 to support and guide the die assembly 20 in the gap between the die support surface 58 and the lower roller 78. As shown in the figures, each idler roller 68 is rotatably mounted to its respective wing 16 and 18 by a pair of opposing bosses 54 extending from the wings 16 and 18 proximate the recessed portions 60.

The rotational axes of the upper and lower rollers 76 and 78, the idler rollers 68, the shaft 74, and the hinges 40 of the two wings 16 and 18 are substantially parallel with one another and generally transverse to the longitudinal axis of the unfolded roller press 10, as shown in FIG. 2.

As illustrated in FIG. 4, the lower roller 78 has an uppermost peripheral portion 80. The tangential axis of this uppermost peripheral portion 80 is substantially co-planer with the die support surfaces 58 when the wings 16 and 18 are in open positions. Likewise, the idler rollers 68 have peripheral portions located at 70. When the wings 16 and 18 are in open positions, the peripheral portions located at 70 have tangential axes that are substantially co-planer with the die support surfaces 58 in order that the die assembly 20 be maintained at a uniform level when being fed into and fed from the roller assembly 14. As further demonstrated by FIG. 4, when the wings 16 and 18 are in open positions (as they would be during use of the roller press 10), an outer surface 102 of each wing housing portion 48 is in substantial contact with the table, counter or other working surface 104 on which the roller press 10 is resting. This contact translates into a very stable die support surface 58 on which large and heavy die assemblies 20 can be placed and supported without concern that the roller press 10 may tip over or undergo any unwanted movement. The contact between surfaces 102 and 104 also provides the roller press 10 with stability when a user is rotating the handle 72.

As demonstrated in FIG. 5, when the wings 16 and 18 are in closed positions and the recessed portions 60 are encasing the roller assembly 14, the idler rollers 68 are positioned generally between the upper and lower rollers 76 and 78 in the feed space 82. Again, this enables the roller press 10 to fold into a compact configuration during transport and storage. In order for this to occur, the hinges 40 and the idler rollers 68 have to be placed such that the arcuate path 106, along which the idler rollers 68 travel when the wings 16 and 18 are being closed, is directed to the fed space 82.

From the foregoing it will be seen that this invention is one well adapted to attain all ends and objects hereinabove set forth together with the other advantages which are obvious and which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A portable roller press comprising:

a base frame having a pair of opposing stanchions;

a drive roller assembly including an upper roller and a lower roller, wherein said upper roller and lower roller extend between and are rotatably mounted to said stanchions;

at least two wings, wherein at least one wing is hingedly coupled to said base frame, and further wherein each wing comprises:

a main wall portion, wherein said main wall portion is movable between at least a closed vertical position and an open horizontal position;

a top wall portion, wherein said top wall portion is raised from the surface of said main wall portion;

a first side wall portion, wherein said first side wall portion is raised from the surface of said main wall portion;

a second side wall portion, wherein said second side wall portion is raised from the surface of said main wall portion;

a plate portion for supporting a die, wherein said plate portion is supported above the surface of said main wall portion when the main wall portion is in said open horizontal position, further wherein said plate portion is comprised of a raised portion and a recessed portion, wherein said raised portion is at a greater height above said main wall portion than said recessed portion when said wing is in said open horizontal position; and an idle roller, wherein said idle roller is located within said recessed portion of said plate portion and configured to extend above said recessed portion when said wing is in said open horizontal position, and wherein said idler roller is located between said upper roller and said lower roller when said wing is in said closed vertical position.

2. The roller press of claim 1, wherein said wings are configured to contact a surface on which said portable roller press rests when said wings are in said open horizontal position in order to stabilize said wings.

3. The roller press of claim 1, wherein said recessed portions of said plate portions of said wings substantially enclose said drive roller assembly when said wings are in said closed vertical position.

4. The roller press of claim 1, wherein at least one wing is hingedly coupled to said pair of opposing stanchions.

5. The roller press of claim 1, wherein at least one wing has a rotational axis substantially parallel with rotational axes of said upper and lower rollers.

6. The roller press of claim 1, wherein said plate portion includes a die support surface.

7. The roller press of claim 6, wherein said lower roller has an uppermost peripheral portion substantially co-planer with said die support surface when said wing is in the open horizontal position.

8. The roller press of claim 7, wherein said idler roller has a peripheral portion substantially co-planer with said die support surface.

9. The roller press of claim 8, wherein said idler roller has a rotational axis substantially parallel with rotational axes of said upper and lower rollers.

10. The roller press of claim 8, wherein said upper roller and lower roller have a feed space therebetween sized to accommodate a die assembly.

11. The roller press of claim 10, wherein said idler roller is positioned at least partially in the feed space between said upper and lower rollers when said wing is in the closed vertical position.

12. The roller press of claim 1, wherein at least one wing further comprises an aperture therethrough defining a handle portion.

13. The roller press of claim 1, further comprising a crank handle operably engaged with at least one of said upper roller and lower roller.

14. The roller press of claim 1, wherein at least one wing is substantially hollow and is configured for holding and transporting items therein.

* * * * *